US006994047B1

(12) United States Patent
Pent, III

(10) Patent No.: US 6,994,047 B1
(45) Date of Patent: Feb. 7, 2006

(54) BOAT MOORING SYSTEM

(76) Inventor: William B. Pent, III, 6016 Palm Creek Dr., Weeki Wachee, FL (US) 34607

( * ) Notice: Subject to any disclaimer, the term of this patent is extended or adjusted under 35 U.S.C. 154(b) by 0 days.

(21) Appl. No.: 10/870,838

(22) Filed: Jun. 17, 2004

(51) Int. Cl.
*B63B 21/00* (2006.01)

(52) U.S. Cl. ..... 114/230.27; 114/230.1

(58) Field of Classification Search ..... 114/230.1, 114/230.16, 230.26, 230.27, 230.29
See application file for complete search history.

(56) References Cited

U.S. PATENT DOCUMENTS 4,480,576 A * 11/1984 Mills ..... 114/230.27
5,341,757 A * 8/1994 Digiacomo ..... 114/230.27
6,216,625 B1 * 4/2001 Baluha ..... 114/230.27

* cited by examiner

*Primary Examiner*—Lars A. Olson
(74) *Attorney, Agent, or Firm*—Louis J. Brunoforte

(57) ABSTRACT

A front post is located in proximity to a bow cleat and a rear post is located in proximity to a stern cleat. A securement assembly operatively couples each post with respect to a dock. A carriage assembly is positioned on each post. The carriage assembly has a collar. The collar is in a cylindrical configuration. The collar is positioned over the majority of its circumferential extent and spaced parallel segments. An axle is located between the parallel segments. A roller is rotatably secured to the axle. An hour glass surface is provided. A first rope has an interior end attached to the collar of the front post and an exterior end couplable to an aft cleat. A second rope has an interior end attached to the collar of the rear post. An exterior end is couplable to a bow cleat.

4 Claims, 3 Drawing Sheets

FIG 1
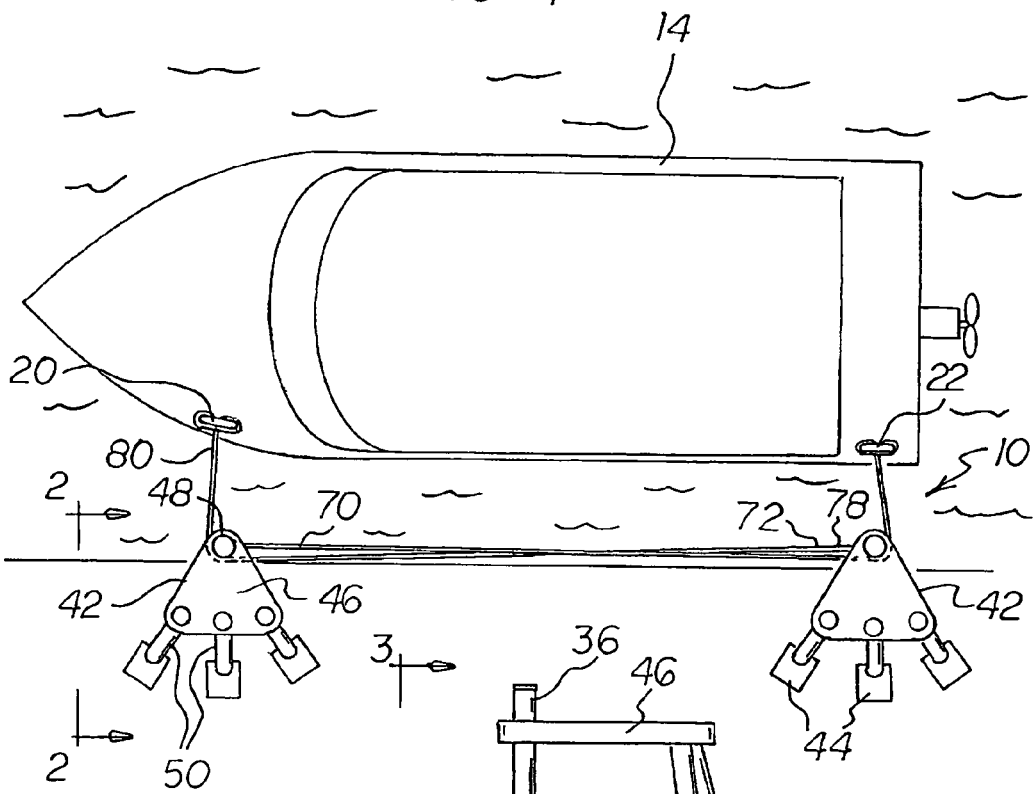
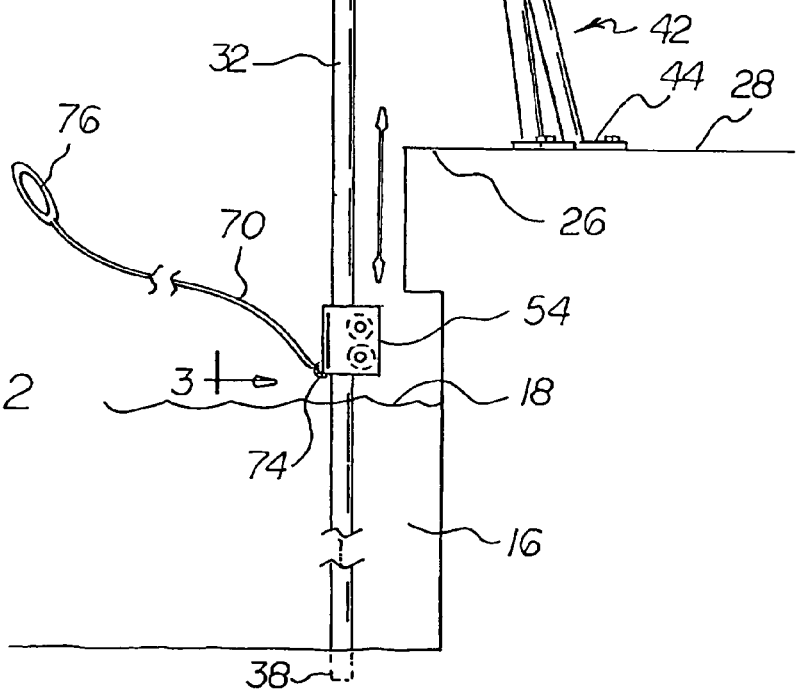
FIG 2

FIG 3
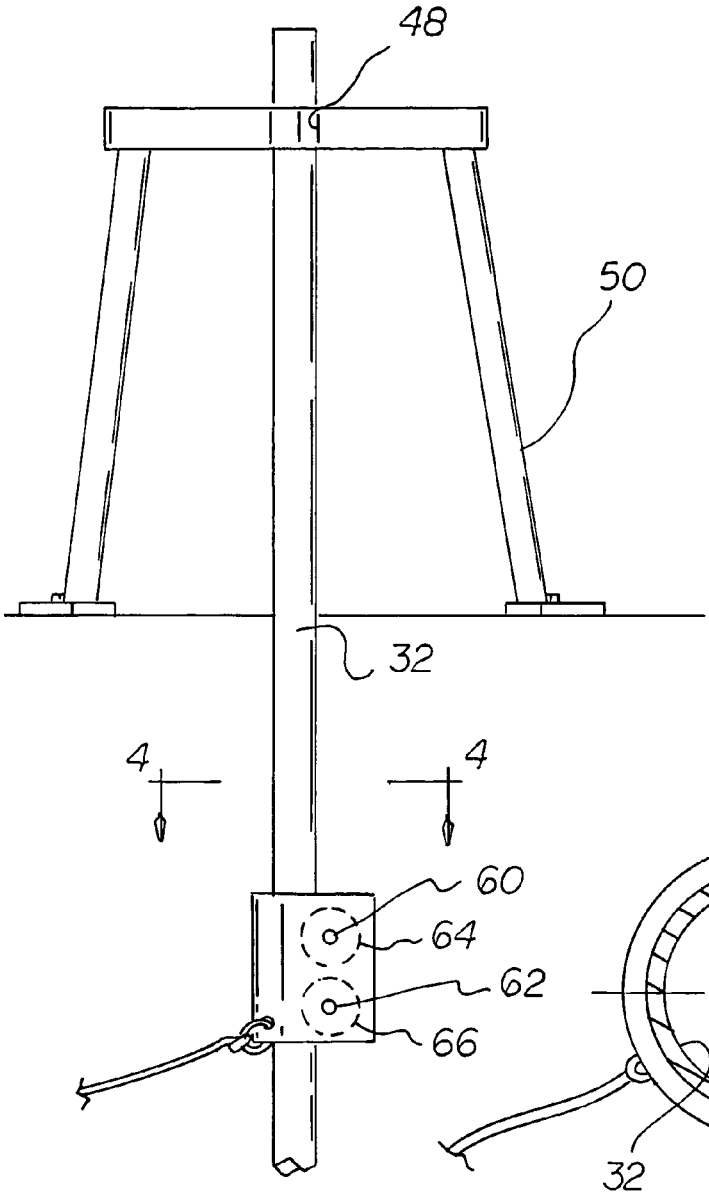
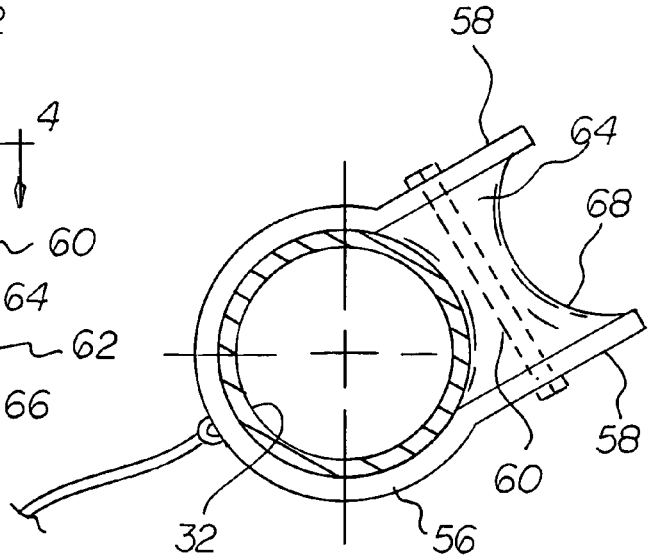
FIG 4

BOAT MOORING SYSTEM

BACKGROUND OF THE INVENTION

1. Field of the Invention

The present invention relates to a boat mooring system and more particularly pertains to securing a boat with respect to a dock in a secure manner while automatically responding to the rise and fall of the tide and variations in the weather.

2. Description of the Prior Art

The use of boat docking systems of known designs and configurations is known in the prior art. More specifically, boat docking systems of known designs and configurations previously devised and utilized for the purpose of docking a boat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,360,716 issued Nov. 8, 1994 to Cotton discloses a boat mooring device and method. U.S. Pat. No. 5,603,280 issued Feb. 18, 1997 to Shackelford discloses a boat mooring apparatus. U.S. Pat. No. 5,694,879 issued Dec. 9, 1997 to Taylor discloses a boat docking apparatus. U.S. Pat. No. 5,762,016 issued Jun. 9, 1998 to Parsons discloses a dock pole bumper assembly. U.S. Pat. No. 5,832,861 issued Nov. 10, 1998 to Taylor discloses a boat docking apparatus. Lastly, U.S. Pat. No. 5,937,781 issued Aug. 17, 1999 to Isella discloses a floating piling attachment device with shock absorbing capabilities.

While these devices fulfill their respective, particular objectives and requirements, the aforementioned patents do not describe boat mooring system that allows securing a boat with respect to a dock in a secure manner while automatically responding to the rise and fall of the tide and variations in the weather.

In this respect, the boat mooring system according to the present invention substantially departs from the conventional concepts and designs of the prior art, and in doing so provides an apparatus primarily developed for the purpose of securing a boat with respect to a dock in a secure manner while automatically responding to the rise and fall of the tide and variations in the weather.

Therefore, it can be appreciated that there exists a continuing need for a new and improved boat mooring system which can be used for securing a boat with respect to a dock in a secure manner while automatically responding to the rise and fall of the tide and variations in the weather and other conditions. In this regard, the present invention as set forth herein, along with its alternate embodiments of the invention substantially fulfills this need.

SUMMARY OF THE INVENTION

In view of the foregoing disadvantages inherent in the known types of boat docking systems of known designs and configurations now present in the prior art, the present invention provides an improved boat mooring system. As such, the general purpose of the present invention, which will be described subsequently in greater detail, is to provide a new and improved boat mooring system and method which has all the advantages of the prior art and none of the disadvantages.

To attain this, the present invention essentially comprises a boat. The boat is positionable in water. The water has a water level. The water level and boat are adapted to rise and fall together with the tide and weather conditions. The boat has a bow. The bow has a bow cleat. The boat also has a stern. The stern has a stern cleat.

A dock is provided. The dock is at the edge of the water. The dock has a securement surface. The securement surface is adjacent to the water and boat at an elevation above the water level.

Provided next is a pair of posts. Each post is hollow. Each post has a cylindrical exterior surface. Each post has a central axis. Each post has a top and a bottom. Each post is vertically positioned. The bottoms are rigidly secured beneath the water. The tops are located at an elevation above the securement surface. The posts include a front post. The front post is located in proximity to the bow cleat. The posts also include a rear post. The rear post is located in proximity to the stern cleat.

A securement assembly is provided. The securement assembly operatively couples each post with respect to the securement surface. Each securement assembly includes three plates. The plates are attached to the securement surface. Each securement assembly also includes a triangular base. The triangular base has an aperture. The aperture receives an associated post adjacent to its top. A portion of the post is above the base. Each securement assembly also includes three angularly oriented legs. The lower ends are secured to associated plates. The upper ends are secured to an associated base.

A carriage assembly is provided. The carriage assembly is positioned on each post beneath the base. Each carriage assembly has a collar. The collar is in a cylindrical configuration. The collar is positioned over the majority of its circumferential extent. The carriage assembly has a central axis. The central axis is coincident with the axis of the post. Each carriage assembly includes spaced parallel segments. The segments extend generally radially from the post. The segments are horizontally oriented. The segments have vertically spaced axles. The axles are located between the parallel segments. Each carriage assembly includes a roller. The roller is rotatably secured to each axle. The rollers of each carriage assembly have an hour glass exterior surface. The exterior surface of each carriage assembly is sized to correspond to the exterior surface of their associated post. Each carriage assembly is further adapted to independently ride up an down its associated post.

Further provided is a nylon first rope and a nylon second rope. The first rope has an interior end. The interior end is attached to the collar of the front post. The first rope has an exterior end. The exterior end is couplable to the aft cleat while mooring and couplable to the rear post above its base when not mooring. The second rope has an interior end. The interior end is attached to the collar of the rear post. The second rope has an exterior end. The exterior end is couplable to the bow cleat while mooring and couplable to the front post when not mooring.

Provided last is an extension assembly. The extension assembly includes a hollow front extension pole. The front extension pole has a front connector. The front connector has a lower end. The lower end is removably positionable into the upper end of the front post. The front connector has an upper end. The upper end is removably positionable in the lower end of the front extension pole. The extension assembly includes a hollow rear extension pole. The rear extension pole has a rear connector. The rear connector has a lower end. The lower end is removably positionable into the upper end of the rear post. The rear connector has an upper end. The upper end is removably positionable in the lower end of the rear extension pole. The extension assembly adapts to accommodate the system in extremely inclement weather.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat mooring system which has all of the advantages of the prior art boat docking systems of known designs and configurations and none of the disadvantages.

It is another object of the present invention to provide a new and improved boat mooring system which may be easily and efficiently manufactured and marketed.

It is further object of the present invention to provide a new and improved boat mooring system which is of durable and reliable constructions.

An even further object of the present invention is to provide a new and improved boat mooring system which is susceptible of a low cost of manufacture with regard to both materials and labor, and which accordingly is then susceptible of low prices of sale to the consuming public, thereby making such boat mooring system economically available to the buying public.

Even still another object of the present invention is to provide a boat mooring system for securing a boat with respect to a dock in a secure manner while automatically responding to the rise and fall of the tide and variations in the weather.

Lastly, it is an object of the present invention to provide a new and improved boat mooring system. A front post is located in proximity to a bow cleat and a rear post is located in proximity to a stern cleat. A securement assembly operatively couples each post with respect to a dock. A carriage assembly is positioned on each post. The carriage assembly has a collar. The collar is in a cylindrical configuration. The collar is positioned over the majority of its circumferential extent and spaced parallel segments. An axle is located between the parallel segments. A roller is rotatably secured to the axle. The roller has an hour glass surface. A first rope has an interior end attached to the collar of the front post and an exterior end couplable to an aft cleat. A second rope has an interior end attached to the collar of the rear post. An exterior end is couplable to a bow cleat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a boat mooring system constructed in accordance with the principles of the present invention.

FIG. 2 is a front elevational view of the system taken along line 2—2 of FIG. 1.

FIG. 3 is a side elevational view of the system taken along line 3—3 of FIG. 2.

FIG. 4 is a cross sectional view of the system taken along line 4—4 of FIG. 3.

The same reference numerals refer to the same parts throughout the various Figures.

DESCRIPTION OF THE PREFERRED EMBODIMENT

Figure 5:
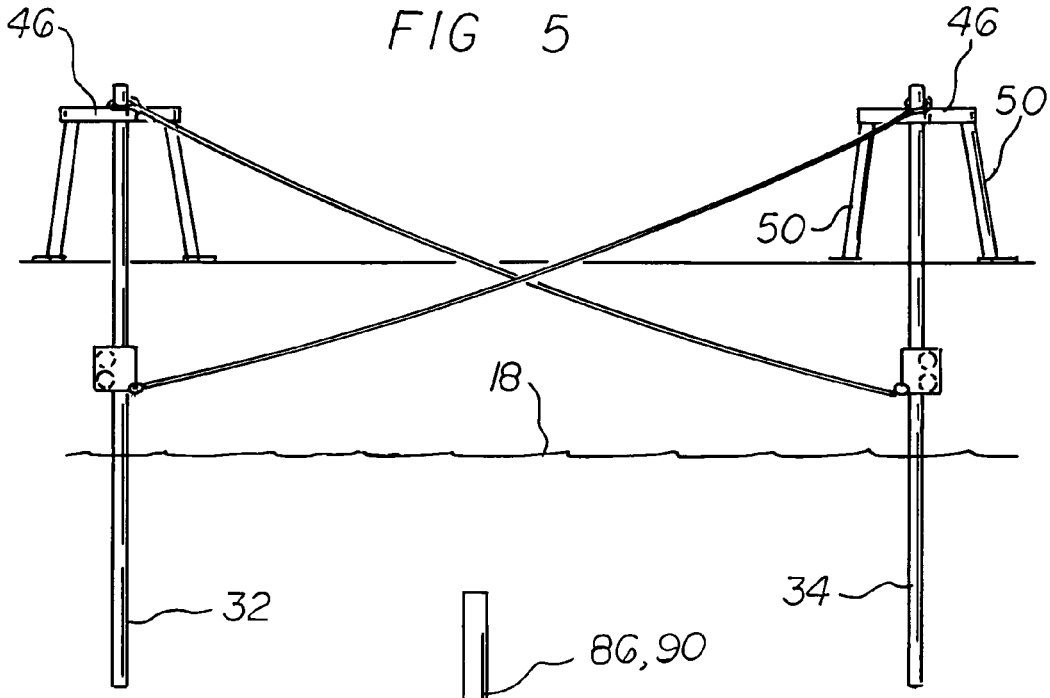
FIG. 5 is a side elevational view of the system but with the boat removed.
Figure 6:
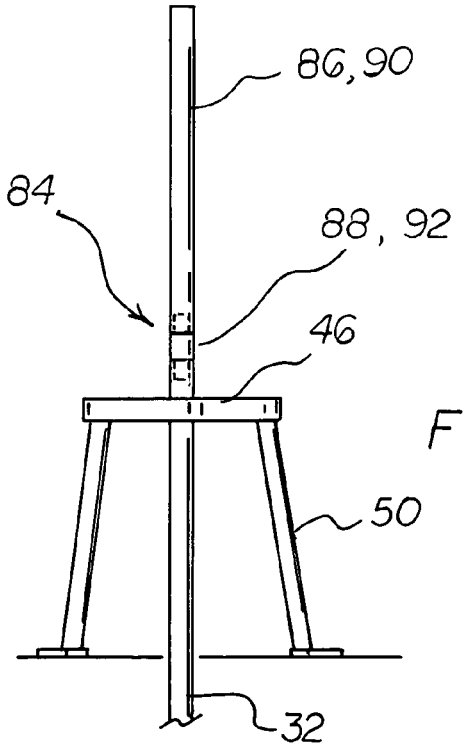
FIG. 6 is a side elevational view similar to the upper extent of FIG. 3 but illustrating a post extender, positionable on the posts, constructed in accordance with an alternate embodiment of the invention.

With reference now to the drawings, and in particular to FIG. 1 thereof, the preferred embodiment of the new and improved boat mooring system embodying the principles and concepts of the present invention and generally designated by the reference numeral 10 will be described.

The present invention, the boat mooring system 10 is comprised of a plurality of components. Such components in their broadest context include a front post, a securement assembly, a carriage assembly, and a first rope. Such components are individually configured and correlated with respect to each other so as to attain the desired objective.

First provided is a boat 14. The boat is positionable in water 16. The water has a water level 18. The water level and boat are adapted to rise and fall together with the tide and weather conditions. The boat has a bow. The bow has a bow cleat 20. The boat also has a stern. The stern has a stern cleat 22.

A dock 26 is provided. The dock is at the edge of the water. The dock has a securement surface 28. The securement surface is adjacent to the water and boat at an elevation above the water level.

Provided next is a pair of posts 32, 34. Each post is hollow. Each post has a cylindrical exterior surface. Each post has a central axis. Each post has a top 36 and a bottom 38. Each post is vertically positioned. The bottoms are rigidly secured beneath the water. The tops are located at an elevation above the securement surface. The posts include a front post 32. The front post is located in proximity to the bow cleat. The posts also include a rear post 34. The rear post is located in proximity to the stern cleat.

A securement assembly 42 is provided. The securement assembly operatively couples each post with respect to the securement surface. Each securement assembly includes three plates 44. The plates are attached to the securement surface. Each securement assembly also includes a triangular base 46. The triangular base has an aperture 48. The aperture receives an associated post adjacent to its top. A portion of the post is above the base. Each securement assembly also includes three angularly oriented legs 50. The lower ends are secured to associated plates. The upper ends are secured to an associated base.

A carriage assembly 54 is provided. The carriage assembly is positioned on each post beneath the base. Each carriage assembly has a collar 56. The collar is in a cylindrical configuration. The collar is positioned over the majority of its circumferential extent. The carriage assembly has a central axis. The central axis is coincident with the axis of the post. Each carriage assembly includes spaced parallel segments 58. The segments extend generally radially from the post. The segments are horizontally oriented. The segments have vertically spaced axles 60, 62. The axles are located between the parallel segments. Each carriage assembly includes a roller 64, 66. The roller is rotatably secured to each axle. The rollers of each carriage assembly have an hour glass exterior surface 68. The exterior surface of each carriage assembly is sized to correspond to the exterior surface of their associated post. Each carriage assembly is further adapted to independently ride up an down its associated post.

Further provided is a nylon first rope 70 and a nylon second rope 72. The first rope has an interior end 74. The interior end is attached to the collar of the front post. The first rope has an exterior end 76. The exterior end is couplable to the aft cleat while mooring and couplable to the rear post above its base when not mooring. The second rope has an interior end 78. The interior end is attached to the collar of the rear post. The second rope has an exterior end 80. The exterior end is couplable to the bow cleat while mooring and couplable to the front post when not mooring. Each rope, adjacent to its exterior end, passes around a roller with a loop formed at its exterior end to facilitate releasable coupling to a cleat or to a post.

Provided last is an extension assembly 84. The extension assembly includes a hollow front extension pole 86. The front extension pole has a front connector 88. The front connector has a lower end. The lower end is removably positionable into the upper end of the front post. The front connector has an upper end. The upper end is removably positionable in the lower end of the front extension pole. The extension assembly 84 includes a hollow rear extension pole 90. The rear extension pole has a rear connector 92. The rear connector has a lower end. The lower end is removably positionable into the upper end of the rear post. The rear connector has an upper end. The upper end is removably positionable in the lower end of the rear extension pole. The extension assembly adapts to accommodate the system in extremely inclement weather.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat mooring system for securing a boat with respect to a dock in a secure manner while automatically responding to the rise and fall of the tide and variations in the weather comprising, in combination:

a boat positionable in water having a water level, the water level and boat adapted to rise and fall together with the tide and weather conditions, the boat having a bow with a bow cleat and a stern with a stern cleat;

a dock at the edge of the water with a securement surface adjacent to the water and boat at an elevation above the water level;

a pair of posts, each post being hollow with a cylindrical exterior surface and having a central axis with a top and a bottom positionable vertically with the bottoms rigidly secured beneath the water and the tops located at an elevation above the securement surface, the posts including a front post located in proximity to the bow cleat and a rear post located in proximity to the stern cleat;

a securement assembly operatively coupling each post with respect to the securement surface, each securement assembly including three plates attached to the securement surface and each securement assembly also including a triangular base having an aperture receiving an associated post adjacent to its top with a portion of the post above the base and each securement assembly also including three angularly oriented legs with lower ends secured to associated plates and upper ends secured to an associated base;

a carriage assembly positioned on each post beneath the base, each carriage assembly having a collar in a cylindrical configuration over the majority of its circumferential extent with a central axis coincident with the axis of the post and with each carriage assembly including spaced parallel segments extending generally radially from the post with horizontally oriented, vertically spaced axles located between the parallel segments and with a roller rotatably secured to each axle, the rollers of each carriage assembly having an hour glass exterior surface sized to correspond to the exterior surface of their associated post, each carriage assembly adapted to independently ride up an down its associated post;

a nylon first rope and a nylon second rope, the first rope having an interior end attached to the collar of the front post and an exterior end couplable to the aft cleat while mooring and couplable to the rear post above its base when not mooring, the second rope having an interior end attached to the collar of the rear post and an exterior end couplable to the bow cleat while mooring and couplable to the front post when not mooring; and an extension assembly including a hollow front extension pole with a front connector having a lower end removably positionable into the upper end of the front post and an upper end removably positionable in the lower end of the front extension pole, the extension assembly including a hollow rear extension pole with a rear connector having a lower end removably positionable into the upper end of the rear post and an upper end removably positionable in the lower end of the rear extension pole, the extension assembly adapts to accommodate the system in extremely inclement weather.

2. A boat mooring system comprising:

a front post located in proximity to a bow cleat and a rear post located in proximity to a stern cleat;

a securement assembly operatively coupling each post with respect to a dock;

a carriage assembly positioned on each post having a collar in a cylindrical configuration over the majority of its circumferential extent and spaced parallel segments and an axle located between the parallel segments and with a roller rotatably secured to the axle an hour glass surface; and a first rope having an interior end attached to the collar of the front post and an exterior end couplable to an aft cleat and a second rope having an interior end attached to the collar of the rear post and an exterior end couplable to a bow cleats; and an extension assembly including a hollow front extension pole with a front connector having a lower end removably positionable into the upper end of the front post and an upper end removably positionable in the lower end of the front extension pole, the extension assembly also including a hollow rear extension pole with a rear connector having a lower end removably positionable into the upper end of the rear post and an upper end removably positionable in the lower end of the rear extension pole, the extension assembly adapts to accommodate the system in extremely inclement weather.

3. The system as set forth in claim 2 wherein each carriage assembly include two horizontal axles vertically spaced with a roller on each axle.

4. The system as set forth in claim 2 wherein the rollers are in an hour glass configuration.

* * * * *

UNITED STATES PATENT AND TRADEMARK OFFICE

CERTIFICATE OF CORRECTION

PATENT NO. : 6,994,047 B1
DATED : February 7, 2006
INVENTOR(S) : William B. Pent, III It is certified that error appears in the above-identified patent and that said Letters Patent is hereby corrected as shown below:

Title page,
Item [76], Inventors, "William B. Pent, III", address should read:
-- 6046 Palm Creek Dr., Weeki Wachee, FL (US) 34607 --.

Signed and Sealed this

Sixth Day of June, 2006

JON W. DUDAS
*Director of the United States Patent and Trademark Office*